United States Patent [19]

Khozai

[11] Patent Number: 4,928,849

[45] Date of Patent: May 29, 1990

[54] SHOE COVER PACKAGE

[76] Inventor: Bahram Khozai, 4701 Kenmore Ave., #904, Alexandria, Va. 22304

[21] Appl. No.: 246,717

[22] Filed: Sep. 20, 1988

[51] Int. Cl.[5] ..... B65D 85/18

[52] U.S. Cl. ..... 221/45; 221/48; 248/215

[58] Field of Search ..... 221/45, 48, 33, 283, 221/282; 206/806; 248/215, 318, 174, 34

[56] References Cited

U.S. PATENT DOCUMENTS

| | | | |
|---|---|---|---|
| D. 239,985 | 5/1976 | Artz . | |
| 1,606,944 | 11/1926 | Johnson . | |
| 2,023,542 | 12/1935 | Peck | 221/45 |
| 2,799,951 | 7/1957 | Rogers . | |
| 2,902,187 | 9/1959 | Cabanban | 221/283 X |
| 2,986,823 | 6/1961 | Kos . | |
| 2,990,950 | 7/1961 | Alexander | 221/45 |
| 3,007,177 | 11/1961 | Jackson et al. . | |
| 3,089,586 | 5/1963 | Cole | 221/45 |
| 3,089,597 | 5/1963 | Kaplan . | |
| 3,112,911 | 12/1963 | Cornwell . | |
| 3,265,246 | 8/1966 | Messenger | 221/283 |
| 3,422,550 | 1/1969 | Robinson . | |
| 3,628,691 | 12/1971 | Hillman | 221/45 |
| 3,976,076 | 8/1976 | Beach . | |
| 4,019,265 | 4/1977 | Epstein . | |
| 4,154,383 | 5/1979 | Honatzis . | |
| 4,228,928 | 10/1980 | Hocker et al. . | |
| 4,272,859 | 6/1981 | Vanhove . | |
| 4,304,021 | 12/1981 | Theodorsen . | |
| 4,487,318 | 12/1984 | Roen . | |
| 4,512,476 | 4/1985 | Herrington, Jr. . | |
| 4,616,428 | 10/1986 | Leger . | |
| 4,644,689 | 2/1987 | Arians . | |
| 4,658,962 | 4/1987 | Burns et al. | 221/45 X |
| 4,703,850 | 11/1987 | Walker . | |

FOREIGN PATENT DOCUMENTS

| | | | |
|---|---|---|---|
| 624300 | 7/1961 | Canada | 221/45 |
| 2203292 | 8/1973 | Fed. Rep. of Germany | 221/45 |
| 1242961 | 8/1960 | France | 221/45 |

*Primary Examiner*—F. J. Bartuska
*Attorney, Agent, or Firm*—James A. Wong

[57] ABSTRACT

A package of disposable shoe covers comprising in combination a dispensing container with a hanger extending therefrom and a series of shoe covers enclosed within the container with the container being made of plastic, cardboard or the like and including at least a front wall, a rear wall, a bottom wall, and an upper wall enclosing the shoe covers; the hanger including at least a first generally vertical portion extending upwardly from the rear wall above the upper wall to an intermediate generally horizontal portion, the intermediate portion extending rearwardly from the first portion at the upper extremity of the first portion, and a second generally vertical portion extending downwardly from the intermediate portion at the rearward edge of the intermediate portion, the intermediate portion extending for a distance of at least the thickness of conventional doors so that the package may be suspended or hung thereby from the upper end of a door and permit the door to open and close without interference between the container and any entrance frame for the door; the container also including an opening adjacent the bottom wall through which the shoe covers may be dispensed; and the series of shoe covers being made of flexible plastic material or the like and interrelated with each other in such manner that each shoe cover of the series may be dispensed individually and consecutively through the dispensing opening from the container.

4 Claims, 1 Drawing Sheet

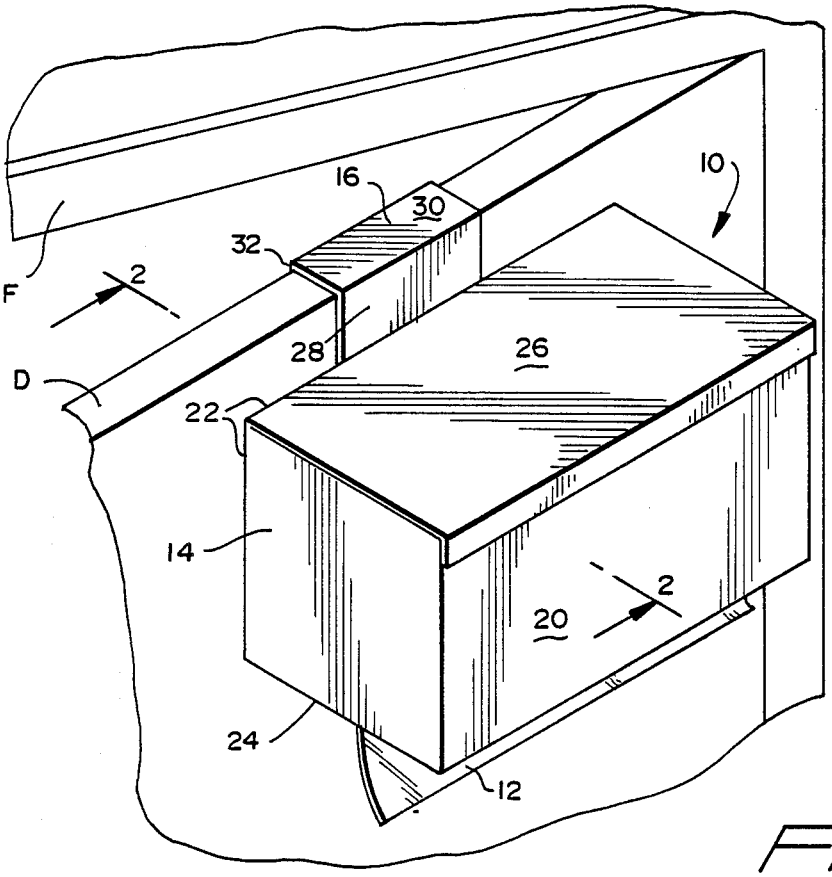
FIG. 1
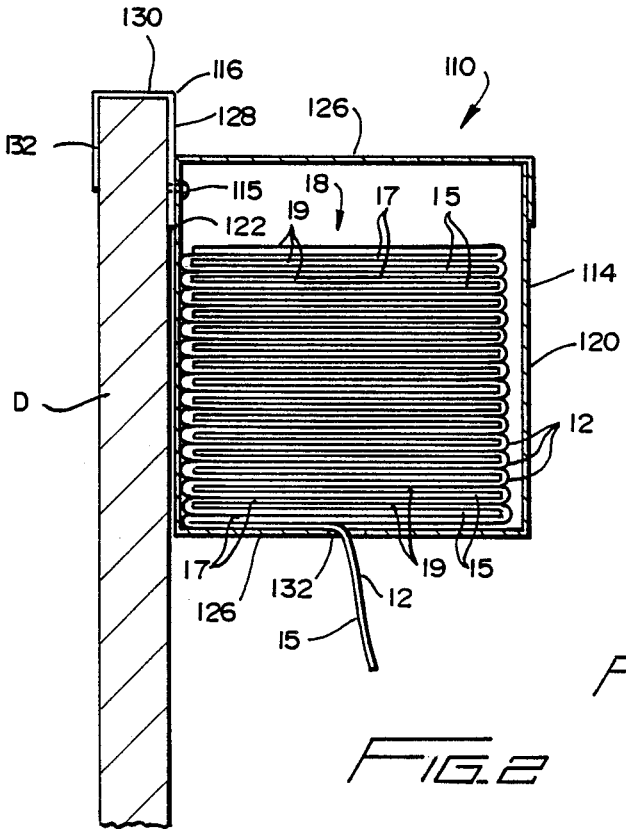
FIG. 2
FIG. 3
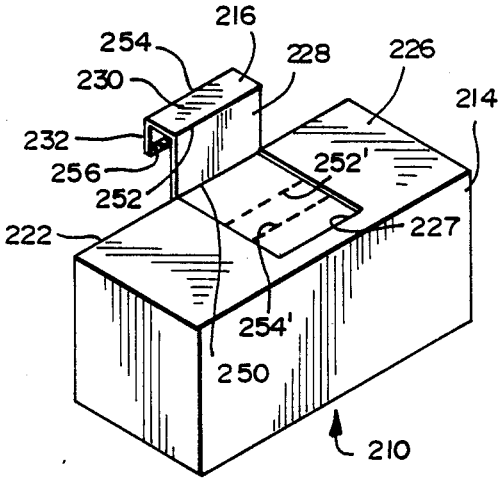
FIG. 4
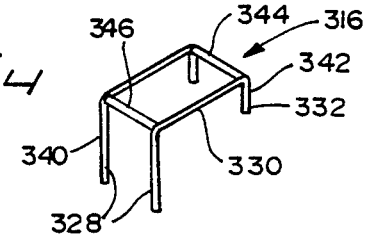

SHOE COVER PACKAGE

BACKGROUND OF THE INVENTION

This invention relates to an apparatus or system by which a homeowner, real estate agent or other housekeeper may readily maintain the premises, in particular carpeting and/or flooring free from dirt, mud, snow or otherwise in immaculate condition despite frequent influx of children, potential purchasers of the home, or other visitors regardless of whether the weather outside is clear, raining, snowing, or whatever. Moreover, the apparatus or system disclosed herein may be used to preclude unnecessary cleaning efforts including those situations when children come in with dirty shoes after playing under ordinary conditions, when repair people enter with greasy shoes, or in the case of a hospital, where objections to dirty floors may be a matter of sanitation and not merely aesthetics. In the past, strips of vinyl plastic have been laid down on the floors in homes by real estate agents, for example, both to guide prospective buyers over a prescribed route and to avoid a cleaning job later. The use of such vinyl material poses the disadvantages of expense, restriction in routes, and unsightliness of the vinyl itself.

SUMMARY OF THE PRESENT INVENTION

With the above background in mind, applicant has conceived of the invention disclosed herein to provide a new and improved apparatus or system to enable homeowners, real estate agents or other housekeepers to maintain the premises of a home substantially completely free from accumulation of soil, mud, rain, snow, grease, and other dirt despite frequent influx of children, maintenance or service people, prospective home purchasers, or even ordinary guests regardless of rain, shine, snow or other weather conditions.

It is an object of this invention to provide a readily available supply of shoe covers in close proximity of the entrance of a home so that immediately prior to or upon entering a home, anyone so entering may avail himself or herself of shoe covers, place same over their shoes, and proceed without soiling the floors and/or carpeting.

It is another object of this invention to provide an ample supply of shoe covers in the vicinity of an entrance from the exterior of a home to accommodate a large number of visitors over a period of time for whatever purpose.

A further object of this invention is to provide a package of shoe covers which may be hung on a door so that anyone entering from outdoors may immediately and conveniently find such shoe covers readily accessible, obtain such shoe covers, and put them to use to preclude requirement of unnecessary cleaning of the premises.

With the foregoing background and objects in mind, the reader will readily appreciate additional advantages flowing from the invention disclosed herein over the prior art devices upon perusing the specification and the various forms of the invention illustrated in the accompanying drawings.

BRIEF DESCRIPTION OF THE DRAWINGS

Referring to the accompanying drawings, the reader will see that:

FIG. 1 represents a front view in perspective looking from the left and down at one form of the shoe cover dispensing system according to the inventive concept disclosed herein;

FIG. 2 represents a view taken along the plane 2—2 and looking in the direction of the arrows in FIG. 1, but of an optional variation of the embodiment in FIG. 1;

FIG. 3 represents a view in perspective of yet another optional embodiment of the disclosed concept; and FIG. 4 represents a view in perspective of an alternate embodiment of a member for supporting the dispensing container according to the inventive concept disclosed herein.

DESCRIPTION OF THE INVENTION

Referring now in detail to the drawings, the reader will redily appreciate from FIGS. 1 and 2 that the disclosed invention resides in a package 10 of disposable shoe covers 12 comprising in combination a dispensing container 14 with hanger element 16 extending therefrom and a series 18 of shoe covers 12 enclosed within container 14. Container 14 may be made of plastic, cardboard or the like and including at least a front wall 20, a rear wall 22, a bottom wall 24, and an upper wall 26 enclosing shoe covers 12. Container 14 illustrated in FIG. 1 is generally rectangular and made of plastic material with hanger 16 also being of plastic and molded as an integral extension. Hanger 116 may be made separately and secured to container 114 by rivet 115, pin or the like members as illustrated in FIG. 2.

Referring again to FIG. 1, it is seen that hanger 16 includes at least a first generally vertical portion 28 extending upwardly from rear wall 22 above upper wall 26 to an intermediate generally horizontal portion 30, with intermediate portion 30 extending rearwardly from the first portion 28 at the upper extremity of the first portion 28, and a second generally vertical portion 32 extending downwardly from the intermediate portion 30 at the rearward edge of the intermediate portion 30. The intermediate portion 30 of hanger 16 extends for a distance of at least the thickness of conventional doors so that package 10 may be suspended or hung thereby from the upper end of a door D and permit the door D to open and close without interference between container 14 and any entrance frame F for the door D. Container 14 also includes an opening adjacent or in bottom wall 24 similar to opening 132 of container 124 through which shoe covers 12 may be dispensed.

As may be seen in FIG. 2 in an alternative embodiment of the disclosed invention, the package 110 of disposable shoe covers 12 comprises in combination a dispensing container 114 with hanger 116 secured to and extending from container 114 and a series 18 of shoe covers 12 enclosed within container 114. Like container 14, container 114 includes at least a front wall 120, a rear wall 122, a bottom wall 124, and an upper wall 126 enclosing shoe covers 12. Hanger 116 can be clearly seen to include at least a first generally vertical portion 128 extending upwardly from rear wall 122 above upper wall 126 to an intermediate generally horizontal portion 130, with intermediate portion 130 extending rearwardly from first portion 128 at the upper extremity of first portion 128, and a second generally vertical portion 132 extending downwardly from intermediate portion 130 at the rearward edge of intermediate portion 130. The intermediate portion 130 of hanger 116 also extends for a distance of at least the thickness of conventional doors so that package 110 may be suspended or hung thereby from the upper end of a door D and permit the door D to open and close without interference between container 114 and any entrance frame for the door. Again, container 114 also includes an opening 132 adjacent or in bottom wall 126 through which shoe covers 12 may be dispensed. Additionally, as clearly illustrated in FIG. 2, the series 18 of shoe covers 12 is made of flexible plastic material or the like with each shoe cover 12 being interrelated with each other in such manner that each shoe cover 12 of series 18 may be dispensed individually and consecutively through dispensing opening 132 from container 114.

While container 14 and hanger 16, which are illustrated in FIG. 1, are described as being made as an integral plastic molding, container 214 and hanger 216, which appear in FIG. 3 as another alternative embodiment of a package 210 within the inventive concept of the present invention, are also made as an integral unit, but of thin cardboard material instead of plastic. A careful look at FIG. 3 shows that container 214 and hanger 216 are formed as an integral unit with hanger 216 originally being part of upper wall 226 and closing the opening 227. Hanger 216 is formed with a first hinge line 250 between first generally vertical portion 228 and rear wall 222, a second hinge line 252 between intermediate portion 230 and first generally vertical portion 228, and a third hinge line 254 between intermediate portion 230 and second generally vertical portion 232. Hanger 216 is seen as an integral part of upper wall 226 and outlined thereon by broken or score lines along the edges of opening 227 to enable separation therefrom and formation or conversion to hanger 216. Dotted lines 252' and 254' correspond to the positions or locations of hinge lines 252 and 254, respectively, prior to conversion of hanger 216 from upper wall 226. Hanger 216 is formed with a coating 256 of adhesive or gum to provide temporary adherence on a door or the like. The adhesive or gum coating 256 is non-transferable and may readily be lifted off a surface such as a door or wall. To protect coating 256 from exposure to dirt in the atmosphere, a plastic covering is or may be provided thereover prior to conversion from upper wall 226.

In FIG. 4, another form of hanger 316 is illustrated. Hanger 316 comprises at least two separately formed, inverted J-shaped members 340, 342 to be secured to the rear wall of the container by pins or the like. The J-shaped members 340, 342 may be in the form of J-shaped rods interconnected to each other by connecting wires 344, 346 or the like and secured to rear wall by pins, barbs or the like. Each of the J-shaped rods 340, 342 includes a relatively long segment 328 and a relatively short segment 332 and an intermediate generally horizontal segment 330. When hanger 316 is assembled with a container according to the present invention, segments 328, 330, and 332 correspond in position and function with portions 28, 30, and 32, respectively, of hanger 16.

As to shoe covers 12, each is formed as a shoe covering, like a large anklet sock or like a bag with an opening to receive therethrough a person's shoe. Each shoe cover 12 would be conveniently and economically made of a flexible plastic sheet material for one-time use and disposal. According to the illustrated form of the invention in FIG. 2, shoe covers 12 are arranged in an assembled series 18 with each shoe cover folded in the form of the letter S. The shoe covers 12, which are of flexible plastic material or the like, are interrelated with each other in such manner that each shoe cover 12 of the series 18 may be dispensed individually and consecutively through dispensing opening 132 from container 114. As may thus be readily seen in FIG. 2, shoe cover 12 of series 18 is folded upon itself generally in the form of the letter S with a leading fold 15, an intermediate fold 17, and a trailing fold 19, wherein the leading fold 15 of a first shoe cover 12 is dispensed first from container opening 132, and further wherein trailing fold 19 of each of shoe cover 12 is folded over the leading fold 15 of the next shoe cover 12 of series 18 except for the last one in series 18 so that as each shoe cover 12 is dispensed from container 114, the leading fold 15 of the next shoe cover 12 is at least partially pulled through opening 132 to become accessible for dispensing. In an actual arrangement, each shoe cover 12 would be folded tightly against the next one so that the folds 15, 17, 19 would not be readily visible as depicted in FIG. 2. Also, instead of the arrangement as illustrated in FIG. 2, each shoe cover 12 may be formed as one integral sheet with score lines between successive shoe covers 12 to facilitate separation for use.

Further, with respect to shoe cover 12, each is made of very thin plastic or other impermeable material with an opening at the top to permit the shoe cover 12 to be slipped over or off a person's shoe. An elastic band is attached around the top of the opening for about two-thirds of the way around the opening so that the opening may be varied from an expansion thereof to permit passage of a shoe to a contraction thereof for retention around a shoe and to accommodate various sizes of shoes. After the shoe covers 12 have been used, they may be discarded. Also, when the container 14 or any disclosed alternative embodiment thereof is empty, it may also be discarded, since it is preferred that it be made of inexpensive material.

It will be obvious to those skilled in the art that various changes may be made without departing from the scope of the invention; and therefore, the invention is not limited to what is shown in the drawings and described in the specification but only as indicated in the appended claims.

What is claimed is:

1. A package of disposable shoe covers comprising in combination a dispensing container with hanging means formed as an integral part thereof and extending therefrom and a series of shoe covers enclosed within said container with:

a. said container being made of cardboard thus suitable for discarding after contents of said container have been dispensed and including at least a front wall, a rear wall, a bottom wall, and an upper wall enclosing said shoe covers;

b. said hanging means being formed originally as part of said upper wall and including at least a first generally vertical portion extending upwardly from said rear wall above said upper wall to an intermediate generally horizontal portion, said intermediate portion extending rearwardly from said first portion at the upper extremity of said first portion, and a second generally vertical portion extending downwardly from said intermediate portion at the rearward edge of said intermediate portion, said hanging means also including a first hinge line between said first generally vertical portion and said rear wall, a second hinge line between said intermediate portion and said first generally vertical portion, and a third hinge line between said intermediate portion and said second generally vertical portion, said second generally vertical portion having a coating of adhesive or gum on its surface for adhering contact with a door with no adhesive being on other portions of said hanging means, said intermediate portion extending for a distance of at least the thickness of conventional doors so that said package may be suspended or hung thereby from the upper end of a door and permit the door to open and close without interference between said container and any entrance frame for the door;

c. said container also including an opening adjacent said bottom wall through which said shoe covers may be dispensed; and d. said series of shoe covers being made of flexible plastic material or the like and interrelated with each other in such manner that each shoe cover of said series may be dispensed individually and consecutively through said dispensing opening from said container.

2. The package as defined in claim 1, wherein each of said shoe covers of said series is folded upon itself generally in the form of the letter S with a leading fold, an intermediate fold, and a trailing fold, wherein the leading fold of a first shoe cover is dispensed first from said container opening, and further wherein said trailing fold of each of said shoe cover is folded over the leading fold of the next shoe cover of said series except for the last one in said series so that as each of said shoe covers is dispensed from said container, the leading fold of the next of said shoe covers is at least partially pulled through said opening to become accessible for dispensing.

3. The package as defined in claim 2, wherein said hanging means formed as an integral part of said upper wall is outlined thereon by score lines enabling separation therefrom to facilitate formation or conversion to said hanging means.

4. The package as defined in claim 3, wherein said adhesive or gum is non-transferable and may readily be lifted off a surface such as a door or wall.

* * * * *